US006347848B1

(12) United States Patent
Cho

(10) Patent No.: US 6,347,848 B1
(45) Date of Patent: Feb. 19, 2002

(54) LOCKING DEVICE FOR DRAWERS OF A CABINET

(75) Inventor: Lien-Chiu Cho, Taichung Hsien (TW)

(73) Assignee: E-Make Co., Ltd. (TW)

( * ) Notice: Subject to any disclaimer, the term of this patent is extended or adjusted under 35 U.S.C. 154(b) by 0 days.

(21) Appl. No.: 09/658,268

(22) Filed: Sep. 8, 2000

(51) Int. Cl.[7] ..... E05B 65/46

(52) U.S. Cl. ..... 312/219; 312/217; 312/218; 292/DIG. 18; 70/78

(58) Field of Search ..... 312/216, 217, 312/218, 219, 222; 70/78, 79, 80, 81; 292/DIG. 18

(56) References Cited

U.S. PATENT DOCUMENTS 1,847,106 A * 3/1932 Turner ..... 312/219 X
3,150,902 A * 9/1964 Naab et al. ..... 312/217
3,318,646 A * 5/1967 Ibel ..... 312/218
3,371,974 A * 3/1968 Vermeersch ..... 312/218
4,478,466 A * 10/1984 Clark et al. ..... 312/217 X
5,257,860 A * 11/1993 Slivon ..... 312/219 X
5,385,039 A * 1/1995 Feldpausch et al. .... 312/219 X
5,782,545 A * 7/1998 Kahara et al. ..... 312/217
5,862,689 A * 1/1999 Wen ..... 312/219 X
6,082,839 A * 7/2000 Chiku ..... 312/217 X
6,109,709 A * 8/2000 Holcomb et al. ..... 312/217 X

* cited by examiner

*Primary Examiner*—Jose V. Chen
*Assistant Examiner*—Hanh V. Tran
(74) *Attorney, Agent, or Firm*—Troxell Law Office PLLC

(57) ABSTRACT

A locking device for drawers of a cabinet, including a case body, several drawers vertically arranged in the interior space of the case body, a slide seat disposed in the case body, a latch plate disposed on each drawer and a detent unit. One end of the latch plate is bent toward the drawer to form a stop section with a predetermined length and inclination angle. The detent unit includes an engaging body and a link. The engaging body is vertically slidably fitted in the slide seat. The engaging body is formed with several engaging holes corresponding to the latch plates of the drawers. An upper end of the engaging body is formed with an elongated hanging slot. The link is perpendicularly passed through the hanging slot to abut against the inner edge of the upper end of the hanging slot. By wax the inclined stop section of the latch plate and the elongated hanging slot, when the engaging body is positoned at a position Where the drawers are locked, in case one of the drawers is not totally pushed in and is not locked, a user only needs to further push the drawer inward. At this time, the engaging body will move upward and then move down to lock the drawer.

11 Claims, 4 Drawing Sheets

LOCKING DEVICE FOR DRAWERS OF A CABINET

BACKGROUND OF THE INVENTION

The present invention relates to a locking device for drawers, and more particularly to a locking device for drawers of a file cabinet or a tool cabinet.

A conventional file or tool cabinet is a substantially rectangular case body with six faces. The case body is formed by several panels defining a space therebetween. Several drawers are horizontally disposed in the space layer by layer for placing documents or tools therein. In order to prevent the documents or tools from being stolen or prevent the drawers from dropping out due to shock or inclination of the ground, the file or tool cabinet is equipped with a locking device for locking the drawers.

In order to lock the respective drawers at one time, a conventional device or such as U. S. Pat. No. 4,966,422 disclose a locking device including an up and down movable latch body disposed on the panel of the case body. Each drawer has a hook section corresponding to a latch hole or a latch section of the latch body. The latch body is drivingly connected with a link. One end of the link extends out of the case body to connect with a rotary mechanism such as a key unit. By means of turning the rotary mechanism, the link is driven to drive the latch body to reciprocally move. Accordingly, the hook section can be latched with the latch hole or latch section to lock the respective drawers at one time.

When locking the drawers, the drawers must be totally pushed into the case body so as to locate the hook section at a position where the hook section is latched with the latch hole or latch section. However, it often takes place that after locking the drawers, a user finds that one or some of the drawers are not totally pushed in and are not locked. Under such circumstance, the user must unlock the drawers and then totally push in the drawers and then again lock the drawers. This makes it inconvenient and troublesome to perform the locking operation for the drawers.

SUMMARY OF THE INVENTION

It is therefore a primary object of the present invention to provide a locking device for drawers of a cabinet. After the locking device is positioned at a locking position, in case one of the drawers is not totally pushed in and not locked, a user can easily conveniently further lock the drawer to complete the locking operation for all the drawers.

According to the above object, the locking device for drawers of a cabinet of the present invention includes a case body, several drawers vertically arranged in the interior space of the case body, a slide seat disposed in the case body, a latch plate disposed on each drawer and a detent unit composed of an engaging body, a link and a rotary section disposed at one end of the link.

The present invention can be best understood through the following description and accompanying drawings wherein:

DETAILED DESCRIPTION OF THE PREFERRED EMBODIMENTS

Figure 1:
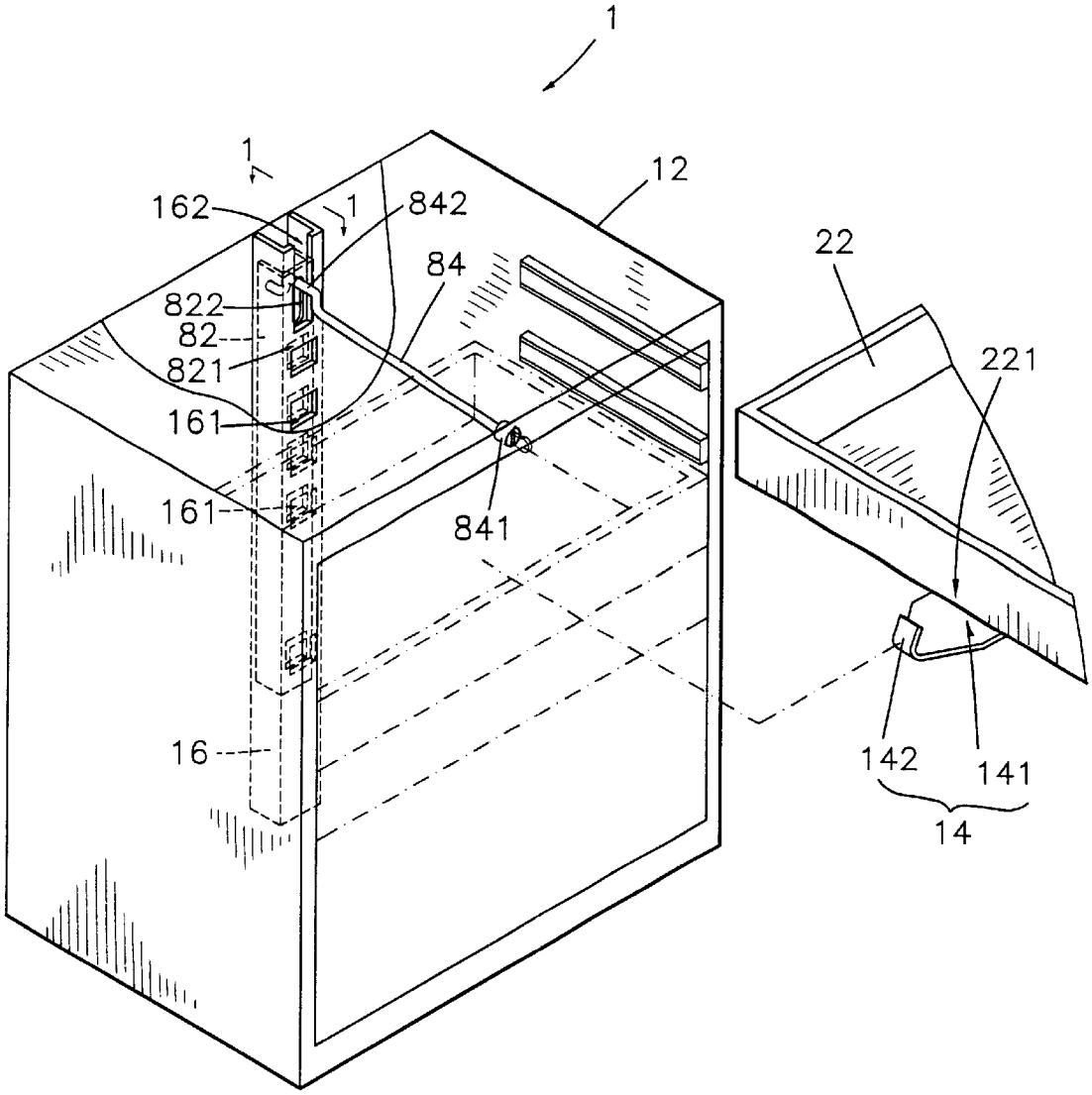
FIG. 1 is a perspective view of a first embodiment of the present invention in an unlocked state.

Please refer to FIGS. 1 to 5. The locking device for drawers of a cabinet 1 of the present invention includes a case body 12, several vertically arranged drawers disposed in the case body 12, a latch plate 14, a slide seat 16 and a detent unit 18.

The case body 12 is a rectangular body composed of five rectangular panels defining an interior space and a vertical open side. Several drawers 22 are vertically arranged in the interior space. The drawers 22 are back and forth slidable through the open side of the case body 12. A predetermined portion of a rear side of each drawer is equipped with a drawer connecting section 221.

The latch plate 14 has a certain length and width. A predetermined portion of one end of the latch plate 14 is formed with a latch plate connecting section 141 for fixedly connecting with the drawer connecting section 221. The other end of the latch plate 14 outward extends by a predetermined length and is bent toward the drawer to form a stop section 142 with a predetermined length and inclination angle which is an acute angle.

The slide seat 16 is a channel body with a U-shaped cross-section, having a predetermined length, a bottom face and two lateral faces. The top edges of the two lateral faces are fixed at a predetermined portion of the inner side of the panel of the case body 12 corresponding to the rear side of the drawer 22. A predetermined portion of the middle portion of the bottom face of the slide seat 16 is formed with a first perforation 161 corresponding to the latch plate 14. The first perforation 161 is such dimensioned that the latch plate 14 can freely get into and out of the first perforation 161 in a direction perpendicular to the bottom face. 1n addition, the upper end of the bottom face is formed with a second perforation 162 vertically extending by a predetermined length.

The detent unit 18 includes an engaging body 82 and a link 84.

The engaging body 82 is a channel body with a substantially U-shaped cross-section, having a predetermnined length, a bottom face and two lateral faces. The engaging body 82 has an outer periphery with a shape substantially corresponding to the shape of the inner periphery of the slide seat 16. The engaging body 82 is lengthwise vertically slidably fitted in the slide seat 16. A predetermined portion of the middle portion of the bottom face of the engaging body 82 is formed with an engaging hole 821 corresponding to the latch plate 14. The engaging hole 821 has a horizontal length larger than the width of the latch plate 14. A predetermined portion of the upper end of the bottom face is formed with a hanging slot 822 vertically extending by a predetermined length.

The link 84 is a rod body with a predetermined length. The link 84 is perpendicularly passed through the second perforation 162 and the hanging slot 822 to abut against the inner edge of the upper end of the handing slot 822. One end of the link 84 is pivotally connected with a predetermined portion of the inner side of the panel of the case body 12 corresponding to the rear side of the drawer 22. The other end thereof corresponds to the front side of the drawer 22 and is pivotally connected with a rotary section 841 protruding out of the case body 12, such as a key unit. A predetermined portion of the link 84 is formed with a bent section 842 abutting against the hanging slot 822. The two end points of the link 84 end the contact point between the bent section 842 and the hanging slot 822 are not positioned on the same line. When the bent section 842 is positioned at a highest point, the engaging hole 821 and the first perforation 161 are mirror symmetrical to each other (in an unlocked state as shown in FIG. 1 ). The vertically extending length of the hanging slot 822 is larger than the maximum length of the cross section of the bent section 842 such as the diameter. Therefore, the bent section 842 is spaced from the lower end of the hanging slot 822 by a predetermined distance.

Figure 2:
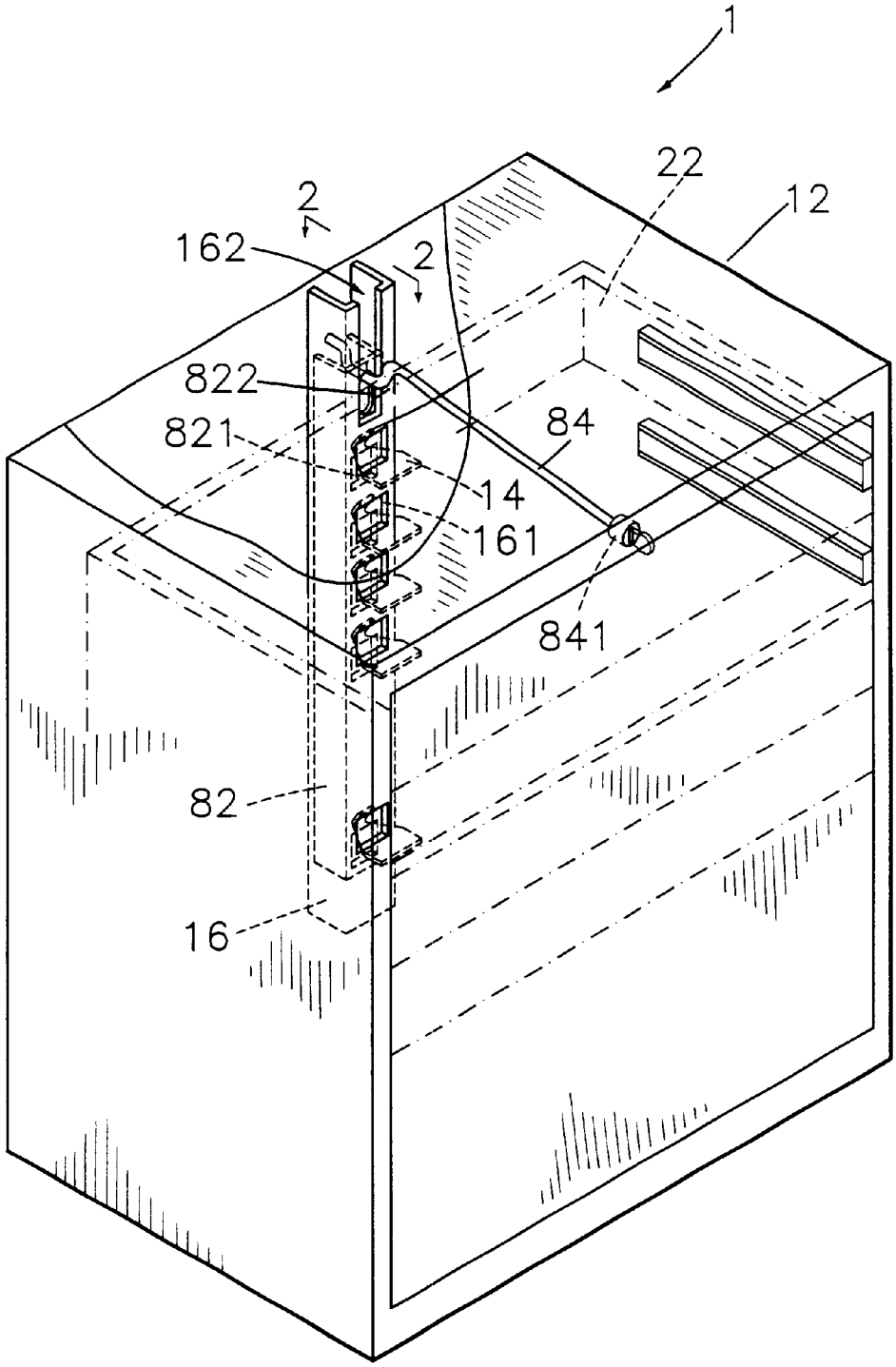
FIG. 2 is a perspective view of the first embodiment of the present invention in a locked state.
Figure 3:
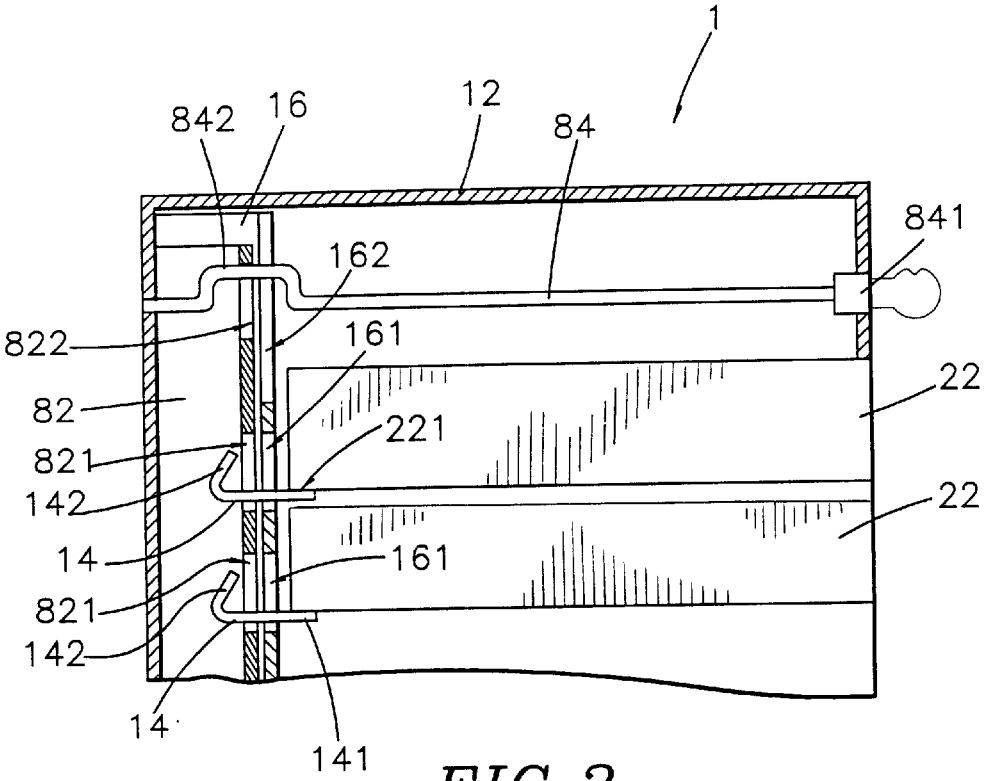
FIG. 3 is a sectional view taken along line 1—1 of FIG. 1.
Figure 4:
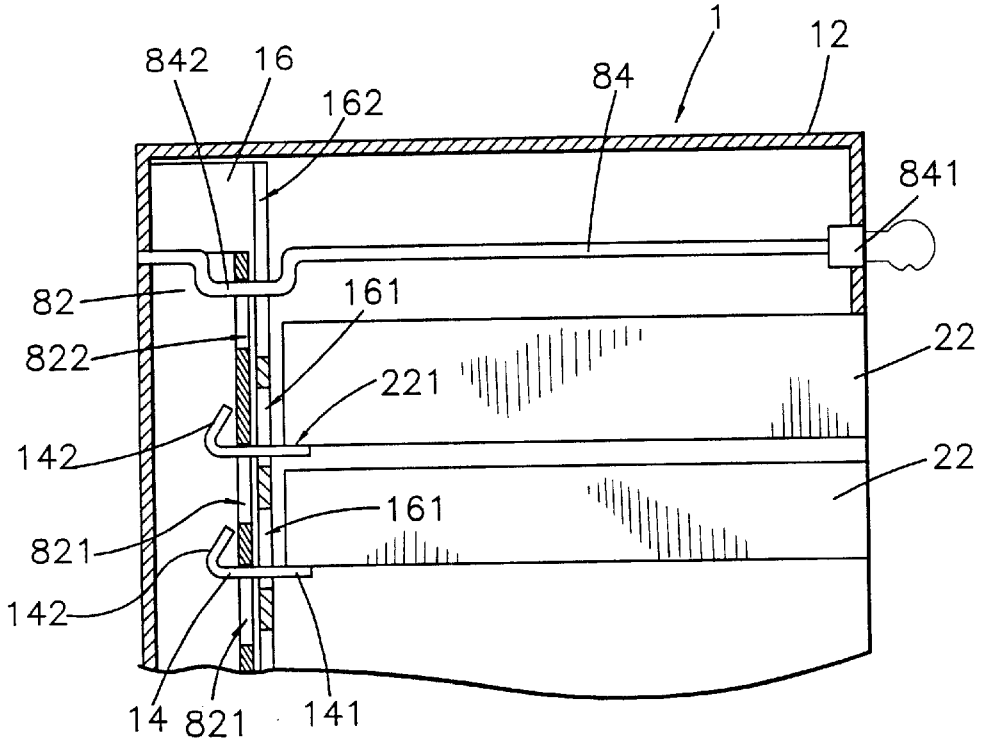
FIG. 4 is a sectional view taken along line 2—2 of FIG. 2.
Figure 5:
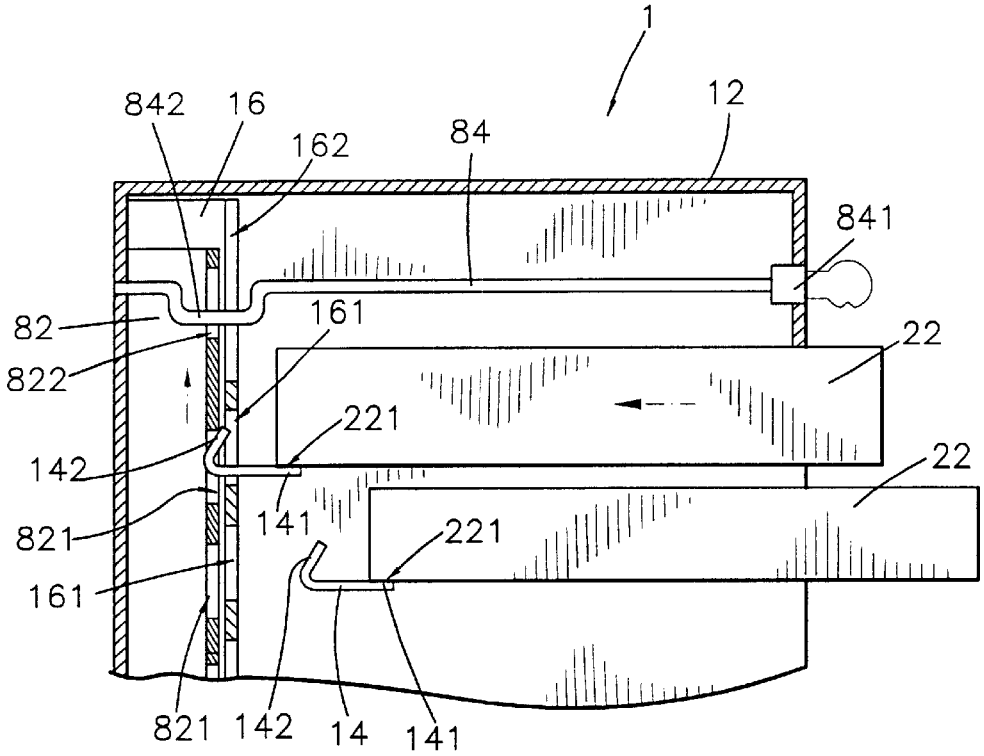
FIG. 5 is a sectional view of the first embodiment of the present invention, showing that the drawer is pushed inward.

By means of the inclined stop section 142 of the latch plate 14 and the elongated hanging slot 822, when turning the rotary section 841 to position the bent section 842 at a lowest point, that is, after the engaging body 82 is lowered to a drawer locking position (in a locked state as shown in FIG. 2), in case one of the drawers is not totally pushed in and is not locked, a user can further push the drawer inward. At this time, the engaging body 82 will be pushed by the stop section 142 to move upward (as shown in FIG. 5) and then go down to complete the locking operation for the drawers.

According to the above arrangement, the drawer locking device of the present invention has the following advantage:

By means of the inclined stop section 142 of the latch late 14 and the elongated hanging slot 822, when the engaging body 82 is positioned at a position where the drawers are locked, in case one of the drawers is not totally pushed in and is not locked, a user only needs to further push the drawer inward. At this time, the engaging body 82 will move upward and then move down to lock the drawer.

Figure 6:
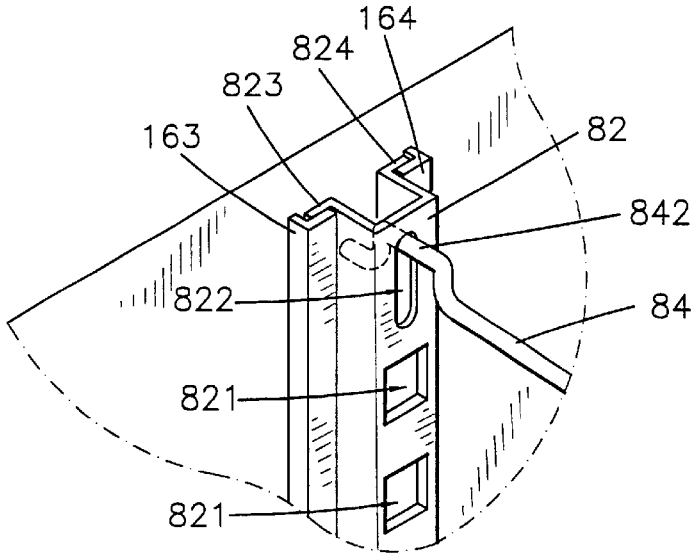
FIG. 6 is a perspective view of a part of a second embodiment of the present invention.

FIG. 6 shows a second embodiment of the drawer locking device 1 of the present invention, in which a predetermined portion of each lateral face of the engaging body 82 is further outward 90 degree bent to form two wing-like slide sections 823, 824.

The slide seat 16 is L-shaped and formed by two plate bodies 163, 164 rather than a channel body with U-shaped cross-section. The plate bodies 163, 164 are symmetrically fixedly disposed on a predetermined portion of inner side of the panel of the case body 12 corresponding to the rear side of the drawer 22 respectively corresponding to the slide sections 823, 824.

The slide sections 823, 824 of the engaging body 82 are lengthwise vertically slidably fitted into the slide seat 16 to achieve the same effect as the above embodiment.

The above embodiments are only used to illustrate the present invention, not intended to limit the scope thereof. Many modifications of the above embodiments can be made without departing from the spirit of the present invention.

What is claimed is:

1. A locking for drawers of a cabinet, comprising:

a case body which is a rectangular body composed of five rectangular panels defining an interior space and a vertical open side, several drawers being vertically arranged in the interior space, the drawers being back and forth slidable through the open side of the case body, a predetermined portion of a rear side of each drawer being equipped-with a drawer connecting section;

a slide seat having a predetermined length, the slide seat being fixed at a predetermined portion of an inner side of the panel of the case body corresponding to the rear side of the drawer;

a latch plate having a predetermined length and width, a predetermined portion of one end of the latch plate being formed with a latch plate connecting section for fixedly connecting with the drawer connecting section, the other end of the latch plate outward extending by a predetermined length and being bent toward the drawer to form a stop section with a predetermined length and inclination angle; and a detent unit including an engaging body and a link, wherein:

the engaging body is a channel body with a substantially U-shaped cross-section, having a predetermined length, a bottom face and two lateral faces, the engaging body being lengthwise vertically slidably fitted in the slide seat of the case body, the bottom face of the engaging body being formed with an engaging hole corresponding to the latch plate of each drawer, the engaging hole being such dimensioned that the latch plate is able to freely get into or get out of the engaging hole in a direction perpendicular to the bottom face of the engaging body, a predetermined portion of the upper end of the bottom face being formed with an elongated hanging slot vertically extending by a predetermined length; and the link is a rod body with a predetermined length, the link being perpendicularly passed through the hanging slot to abut against the inner edge of the upper end of the hanging slot, one end of the link being pivotally connected with a predetermined portion of the inner side of the panel of the case body corresponding to the rear side of the drawer, the other end thereof corresponding to the front side of the drawer and being pivotally connected with a rotary section protruding out of the case body, a predetermined portion of the link being formed with a bent section abutting against the hanging slot, the two end points of the link and the contact point between the bent section and the hanging slot being not positioned on the same line, whereby when the bent section is positioned at a highest point, the engaging hole permits the latch plate to freely get into or get out of the engaging hole in a direction perpendicular to the bottom face of the engaging body, the bent section being spaced from the lower end of the hanging slot by a predetermined distance.

2. A locking device for drawers of a cabinet as claimed in claim 1, wherein a predetermined portion of each lateral face of the engaging body is outward bent to form two wing-like slide sections, the slide seat of the case body being formed by two plate bodies with a predetermined length, the plate bodies having a shape corresponding to the shape of the slide sections, the plate bodies being symmetrically fixedly disposed on a predetermined portion of inner side of the panel of the case body corresponding to the rear side of the drawer respectively corresponding to the slide sections.

3. A locking device for drawers of a cabinet as claimed in claim 1, wherein the slide seat of the case body has a cross-section with a shape corresponding to the shape of the cross-section of the engaging body, the slide seat being a channel body having a predetermined length, a bottom face and two lateral faces, top edges of the two lateral faces being fixed at a predetermined portion of the inner side of the panel of the case body corresponding to the rear side of the drawer, a predetermined portion of the bottom face of the slide seat being formed with a first perforation corresponding to the latch plate of each drawer an upper end of the bottom face being formed with a second perforation vertically extending by a predetermined length, the link being passed through the second perforation.

4. A locking device for drawers of a cabinet as claimed in claim 1, wherein two ends of the link are coaxially rotatably arranged.

5. A locking device for drawers of a cabinet as claimed in claim 2, wherein two ends of the link are coaxially rotatably arranged.

6. A locking device for drawers of a cabinet as claimed in claim 3, wherein two ends of the link are coaxially rotatably arranged.

7. A locking device for drawers of a cabinet as claimed in claim 4, wherein the rotary section is a key unit.

8. A locking device for drawers of a cabinet as claimed in claim 5, wherein the rotary section is a key unit.

9. A locking device for drawers of a cabinet as claimed in claim 6, herein the rotary section is a key unit.

10. A locking device for drawers of a cabinet as claimed in claim 2, wherein the slide seat of the case body is an L-shaped body formed by two plate bodies corresponding to the slide sections of the engaging body.

11. A locking device for drawers of a cabinet as claimed in claim 1, Wherein the inclination angle of the stop section is an acute angle.

* * * * *